US008585837B2

(12) United States Patent
Otsuki et al.

(10) Patent No.: US 8,585,837 B2
(45) Date of Patent: Nov. 19, 2013

(54) HIGH-MANGANESE SPHEROIDAL GRAPHITE CAST IRON

(75) Inventors: Eiji Otsuki, Akita (JP); Toshiharu Kon, Akita (JP); Ren Oyake, Akita (JP)

(73) Assignee: Hokkou Metal Industry Co., Ltd., Akita (JP)

( * ) Notice: Subject to any disclaimer, the term of this patent is extended or adjusted under 35 U.S.C. 154(b) by 13 days.

(21) Appl. No.: 13/147,915

(22) PCT Filed: Feb. 1, 2010

(86) PCT No.: PCT/JP2010/051318
§ 371 (c)(1),
(2), (4) Date: Aug. 4, 2011

(87) PCT Pub. No.: WO2010/090151
PCT Pub. Date: Aug. 12, 2010

(65) Prior Publication Data

US 2011/0290384 A1 Dec. 1, 2011

(30) Foreign Application Priority Data

Feb. 9, 2009 (JP) ..... 2009-026879

(51) Int. Cl.
*C21D 5/00* (2006.01)

(52) U.S. Cl.
USPC ..... 148/614; 148/619

(58) Field of Classification Search
USPC ..... 148/612–620, 321–324, 337; 420/72–76, 9–33
See application file for complete search history.

(56) References Cited

U.S. PATENT DOCUMENTS

2010/0284849 A1 * 11/2010 Sugiyama et al. ..... 420/10

FOREIGN PATENT DOCUMENTS

| | | | |
|---|---|---|---|
| DE | 10049598 A1 * | | 4/2002 |
| JP | 48-094615 | | 12/1973 |
| JP | 50-085515 | | 7/1975 |
| JP | 52-065125 | | 5/1977 |
| JP | 54-17683 | * | 7/1979 |
| JP | 58-027951 | | 2/1983 |
| JP | 61-009549 | | 1/1986 |
| JP | 64-036747 | | 2/1989 |
| JP | 2004-218027 | | 8/2004 |

OTHER PUBLICATIONS

Machine-English translation of German patent, DE 10049598 A1, Veutgen Hans Juergen, Apr. 18, 2002.*
Statement of Relevancy of Japanese patent No. 54-17683 dated Jul. 2, 1979.*
Search report from PCT/JP2010/051318, mail date is Apr. 27, 2010.

* cited by examiner

*Primary Examiner* — Deborah Yee
(74) *Attorney, Agent, or Firm* — Greenblum & Bernstein, P.L.C.

(57) ABSTRACT

The manufacturing method of high-manganese spheroidal graphite cast iron with exhibiting low magnetism, and excellent wear resistance, castability, and machinability, and having a composition which consists of, 2.5 to 4.0 wt. % of C content, 1.5 to 6.0 wt. % of Si content, 7.0 to 18.0 wt. % of Mn content, and 0.015 to 0.1 wt. % of Mg content, and when the Mn content falls within the range of 7.0 to 10.0 wt. %, consists of 10.0 wt. % or smaller of Ni content, or when the Mn content falls within the range of 10.0 to 18.0 wt. %, consists of Ni content being in the range satisfies the following formula: [Mn wt. %>Ni wt. %], the method comprises heating the above cast iron to the temperature of 1073 to 1373K to decompose the carbides, and then quenching from 1073 to 1273K the resulting cast iron to form a metastable austenite matrix structure that contains no carbide or a reduced amount of carbides.

4 Claims, 7 Drawing Sheets

Relation between Mn content and proof strength

Relation between Mn content and proof strength

Relation between Ni content and proof strength

Example 17, in the as-cast state X-ray diffraction results

Example 17, after heat treatment X-ray diffraction results

HIGH-MANGANESE SPHEROIDAL GRAPHITE CAST IRON

BACKGROUND OF THE INVENTION

1. Field of the Invention

The present invention relates to production of a low-magnetic cast iron of which matrix structure principally consists of austenite by containing a proper balance of austenite-stabilizing elements, manganese (Mn) and carbon (C), in its cast iron composition. In addition, it relates to a spheroidal graphite cast iron which has quality of material with excellent wear resistance by high work hardening ability caused by containing a large amount of Mn, and with suppressed strength reduction because of existence of graphite in the matrix structure by making the shape of graphite spheroidal being the characteristic of this cast iron and dispersed in the matrix structure, and stress concentration around graphite reduced. Furthermore, it relates to a nonmagnetized and toughened spheroidal graphite cast iron by heat treatment suitable for the cast iron according to the present invention.

2. Description of the Related Art

Austenitic spheroidal graphite cast irons and high-manganese steels are non-magnetic or low magnetic, since their matrix structures are mainly austenite and the austenite is non-magnetic. Ferromagnetic materials with high magnetic permeability have problems that heat is produced, large energy loss is produced, and the material itself is heated by eddy current induced from electromagnetic induction around strong electromagnets. As structural materials for such a condition, ductile Ni-resist cast irons and austenitic stainless-steels are used.

Spheroidal graphite cast irons are materials although being a type of cast irons with very small influence on strength reduction by graphite dispersed in the matrix structure, since, just as their name says, the shape of graphite is spheroidal. In addition, they have better castability when compared with steels, and have excellent machinability for their hardness. Among austenitic spheroidal graphite cast irons, ductile Ni-resist cast irons are widely known, and are used for such as exhaust manifolds, vacuum pumps, and working machines that require thermal-stability, corrosion resistance, and small thermal expansion coefficient. Also, they are low magnetic and have excellent low-temperature toughness, since their matrix structures are austenite. However, since they comprise 12-36 weight % of Ni, their cost as structural materials for low-magnetism and low-temperature toughness is too high. In addition, a problem is left as structural materials that, since they comprise a large amount of Ni, their proof strength and tensile strength are moderate as 210-310 MPa and 370-500 MPa, respectively. As for an austenitic spheroidal graphite cast iron in which a part of Ni was substituted with Mn, it is shown in Prior Art Document, JP Unexamined Patent Publication No. 2004-218027 (Patent Document 1).

High-manganese steels are a kind of materials invented by an English inventor, Robert Abott Hadfield, in 1882, and most commonly comprise 1 wt. % of C and 13 wt. % of Mn. They are unique materials, since they have high strength, toughness, and high work hardening ability, only processed surface is hardened and have higher wear resistance, while not processed inner parts is soft and have high toughness. Usually, excellent quality of materials described above is realized by heat treatment. Since their matrix structure is austenite, they are non-magnetic, and they have toughness even at the liquid nitrogen temperature (77K) since austenite is stable, and their application in low-temperature environments is becoming larger. Again in recent years, they have received attention as structural materials around nuclear fusion reactors and superconductivity systems, and as structural materials for such as guide way of linear motor cars and liquefied gas storage tanks. However, high-manganese steels have very low machinability, and although their cost is lower when compared with other austenitic steels, their demand expansion is limited. Furthermore, when compared with cast irons, their melting point is higher and their castability is worse, and have problems that it is very difficult to manufacture products with complex and thin shapes.

Patent Document 1: JP Unexamined Patent Publication No. 2004-218027

SUMMARY OF THE INVENTION

Problems to be solved by the present invention are to compromise 7.0-18.0 wt. % of Mn in a cast iron composition, and to produce a cast iron in which structure spheroidized graphite is dispersed, to produce a spheroidal graphite cast iron with low magnetism, excellent wear resistance, castability, and machinability, and to provide a spheroidal graphite cast iron with no magnetism, excellent toughness, low-temperature toughness, wear resistance, castability, and machinability by heat treatment suitable for the cast iron according to the present invention.

A high-manganese spheroidal graphite cast iron according to the present invention consists of, 2.5 to 4.0 wt. % of C content, 1.5 to 6.0 wt. % of Si content, 7.0 to 18.0 wt. % of Mn content, and 0.015 to 0.1 wt. % of Mg content, and when the Mn content falls within the range of 7.0 to 10.0 wt. %, consists of 10.0 wt. % or smaller of Ni content, or when the Mn content falls within the range of 10.0 to 18.0 wt. %, consists of Ni content being in the range satisfies the following formula (I), with the balance being Fe and impurities. Although the cast iron contains a large amount of Mn, by treating the molten metal with spheroidizing, and pouring the molten metal after inoculation, the spheroidal graphite cast iron in which spheroidal graphite is dispersed in the matrix structure can be obtained.

$$\text{Mn \%} > \text{Ni \%} \quad (1)$$

According to the present invention of producing method of a high-manganese spheroidal graphite cast iron, by heating the cast iron described in (1) above to a temperature of 1073 to 1373K to decompose the carbides, and then quenching from 1073 to 1273K the resulting cast iron, a metastable austenite matrix structure that contains no carbide or a reduced amount of carbides can be obtained at ordinary temperature.

The present invention on a high-manganese spheroidal graphite cast iron realizes a cast iron comprising 7.0-18.0 wt. % of Mn in its composition and in which matrix structure spheroidized graphite is dispersed, and makes production of the spheroidal graphite cast iron with low magnetism, excellent wear resistance, castability, and machinability possible. Furthermore, the present invention, by treating with heating suitable for the cast iron according to the present invention makes production of the spheroidal graphite cast iron with no magnetism, excellent low-temperature toughness, toughness, wear resistance, castability, and machinability possible. Since its matrix structures are mainly austenite and it becomes non-magnetic, and it has a quality of material with excellent low-temperature toughness. Since its matrix structures are high-Mn compositions, its cutting is originally difficult, but existence of spheroidal graphite improves its machinability, and high work hardening ability by Mn makes it a material with excellent toughness and wear resistance.

And excellent castability of the cast iron makes production of products with a complex shape possible.

DETAILED DESCRIPTION OF THE PREFERRED EMBODIMENTS

Figure 1:
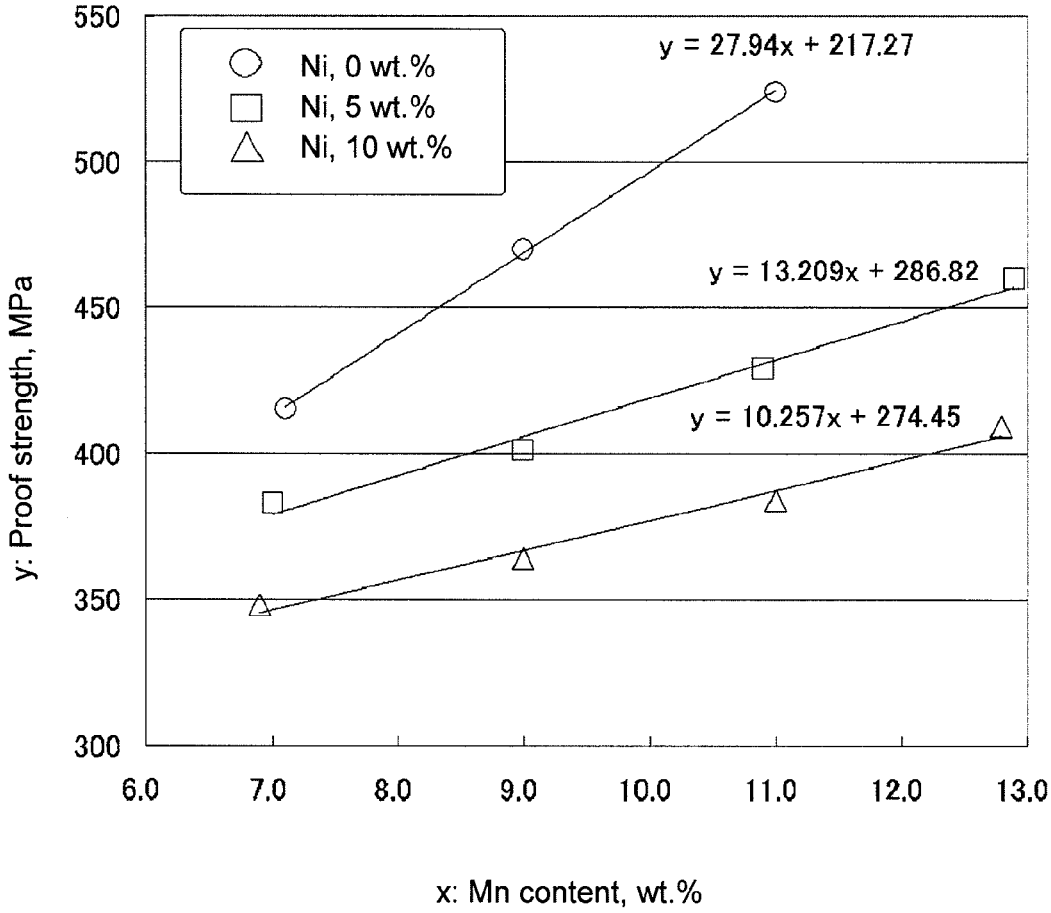
FIG. 1 is a graphical representation showing the relation between Mn content and proof strength.

The inventors earnestly repeated experiments to realize a cast iron comprising 7.0-20.0 wt. % of Mn in its composition and in which matrix structure spheroidal graphite is dispersed, and found that, by not adding Ni or by adding Ni when needed, a cast iron comprising 7.0-20.0 wt. % of Mn in its composition and in which matrix structure spheroidal graphite is dispersed can be produced. Although its as-cast structure consisted of austenite+carbide+spheroidal graphite and it was low-magnetic and had wear resistance, however since carbide, especially grain boundary carbide was deposited, its strength was low and its elongation was small. Therefore, the inventors changed production conditions and repeated heat-treating tests, and found that, by treating with heating suitable for the cast iron, the cast iron with excellent properties can be obtained. In particular, by adding 7.0-18.0 wt. % of Mn to a molten metal of a cast iron, giving graphite spheroidizing treatment, and after inoculation casting in a mold, a cast iron of which matrix structure consists of austenite, carbide, and spheroidal graphite is produced. In addition, by adding Ni, to regulate C solid solution amount in the matrix structure after heat treatment, and the material is made to meet the objective mechanical properties, furthermore, by adding a larger amount of Ni, the material is made to have low-temperature toughness. In these cases, if a larger amount of Ni than that of Mn is added, the proof strength of the cast iron reduces, and it becomes not suitable as a structural material. Ni content must be smaller than that of Mn. However, when Mn content is from 7.0 to 10.0 wt. % and Ni content is 10.0 wt. %, its low-temperature impact properties are especially excellent, and Ni content for low-temperature materials shall be 10.0 wt. % or lower.

As described above, a cast iron in the as-cast state, although being low-magnetic and having wear resistance, has carbide, especially grain boundary carbide, and it is not suitable for applications requiring high strength and impact resistances. However, by giving heat treatment to decompose carbides, reducing or extinguishing massive carbides and grain boundary carbides, a material having excellent toughness, low-temperature toughness, wear resistance, castability, and machinability can be realized, and furthermore making magnetic permeability lower than that as-casted, non magnetism shown by μ being 1.02 or smaller can be realized. The heat treatment in the present invention is performed to decompose carbides by high-temperature heating and to quench from the predetermined temperature at the suitable temperature for the cast iron. That is, if a cast iron is held in the austenitizing temperature range, since the carbon solid solution amount into austenite becomes larger as the holding temperature is higher, and also the solid solution amount after cooling becomes larger, and grain boundary carbide is more easily deposited. Therefore, the present inventors invented a method to set up the carbide decomposition temperature and quenching temperature separately, and to select the quenching temperature at which grain boundary carbide does not deposit. The component range and heat treatment are particularly described below.

C and Si are indispensable to crystallize graphite, and if contents of C and Si are smaller than 2.5 wt. % and 1.5 wt. %, respectively, ledeburite structure becomes dominant, and the cast iron is very brittle. Normally, content of Si is 2.5 wt. % or more, but when a large amount of Ni, a graphitization promoting element, is contained, a cast iron can be produced even with Si content of 1.5 wt. %. In addition, since Si has effects to increase the graphite grain number, to reduce the as-cast carbide deposition amount, carbide decomposition treating time may be further shortened as Si content becomes higher. However, if Si content becomes more than 6.0 wt. %, too many carbides decompose in austenite grain boundary, and strength and toughness of the cast iron are reduced. Accordingly, contents of C and Si shall be 2.5-4.0 wt % and 1.5-6.0 wt %, respectively.

Mn that stabilizes austenite through coexistence with C and is indispensable to induce work hardening is the most important element in the present invention. When Mn content is smaller than 7.0 wt %, austenite is unstable, and when quenched, martensite deposits, and the cast iron shows embrittlement tendency. On the other hand, as Mn content becomes larger, C solid solution amount in the austenite after heat treatment becomes larger, and the cast iron shows embrittlement tendency, but it is known that the embrittlement tendency can be inhibited by adding several wt. % or more of Ni. However, if Mn content is more than 18.0 wt. %, inhibition of embrittlement by adding Ni is difficult, therefore, Mn content shall be 18.0 wt. % or less. Accordingly, Mn content shall be 7.0 to 18.0 wt. %.

Figure 2:
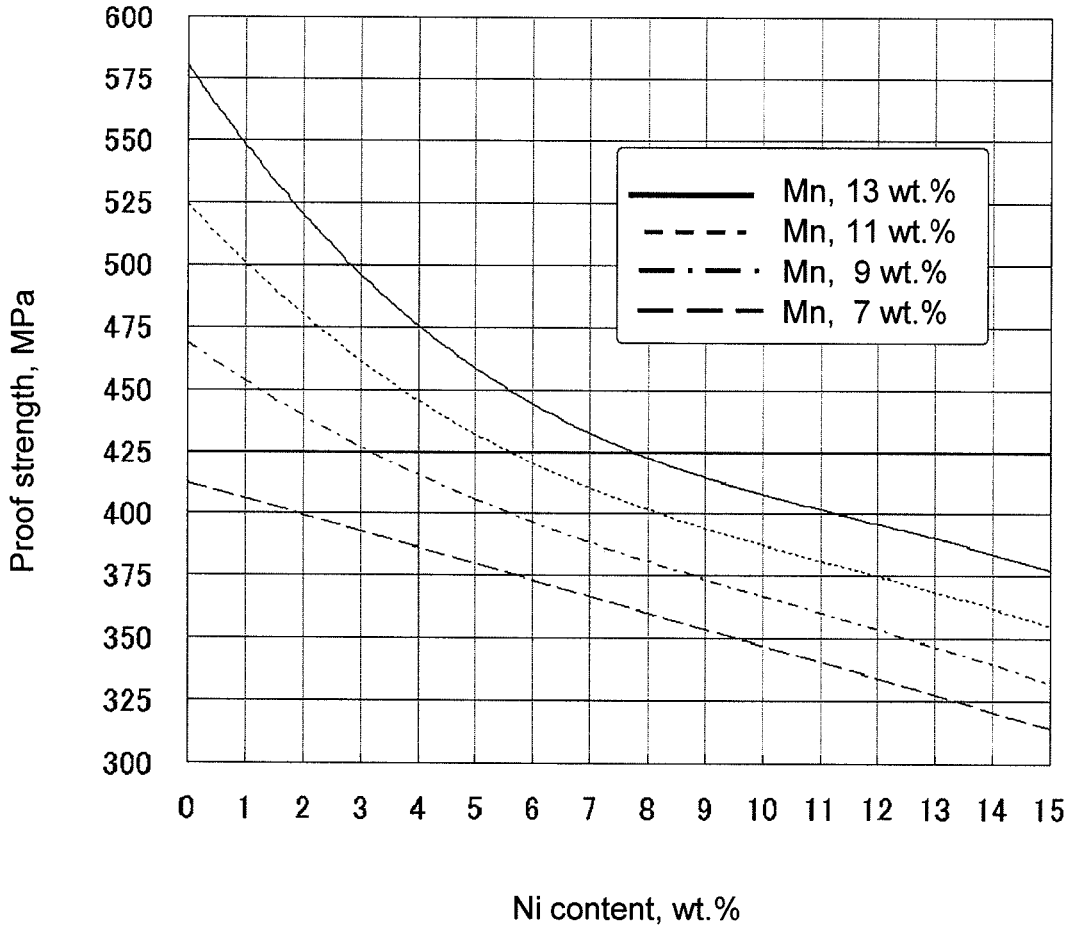
FIG. 2 is a graphical representation showing the relation between Ni content and proof strength.

Ni has effects to promote graphitization and to shorten carbide decomposition time. In addition, it has effects to improve non-magnetism and impact resistant properties at low temperature, and to stabilize austenite at low temperature such as 203K and 77K. However, if too much amount of Ni to the content of Mn is added, the proof strength is reduced, and the cast iron becomes unsuitable as a structural material. The relation between Mn content and proof strength is shown in FIG. 1. It illustrates results of Examples described later graphically. It indicates that as Mn content becomes larger, proof strength increases linearly, and as Ni content becomes larger, proof strength falls down. In addition, a graph in which, as for the same results, Ni contents are indicated on the horizontal axis, and approximation with curves and straight lines is performed, is shown as FIG. 2. In FIG. 2, curves and straight lines are extended to the points responding to Ni content of 15 wt. %. It indicates that, proof strength of 350 MPa or more can be ensured, when focusing on the straight line of Mn content of 7 wt. %, in the range of Ni content of 7.0 wt. % or less, focusing on the curve of Mn content of 9 wt. %, in the range of Ni content of 9.0 wt. % or less, focusing on the curve of Mn content of 11 wt. %, in the range of Ni content of 11.0 wt. % or less, and focusing on the curve of Mn content of 13 wt. %, in the range of Ni content of 13.0 wt. % or less.

When Mn content is 7.0 to 10 wt. %, the proof strength in the Example in which Ni content is 10.0 wt. % is low due to the reason described above and less than 350 MPa, but, on the other hand, its low-temperature impact values show especially excellent tendency and its tensile strength of 550 MPa or more is ensured, and when Mn content is 7.0 to 10 wt. %, Ni content shall be 10 wt. % or less. Accordingly, as for Ni content, when Mn content is 7.0 to 10 wt. %, Ni content shall be 10 wt. % or less, and when Mn content is 10.0 to 18.0 wt. %, Ni content shall be as indicated by formula (I):

$$\text{Mn content (wt. \%)} > \text{Ni content (wt. \%)} \quad (1)$$

Mg is an indispensable element for spheroidizing graphite. If Mg content is less than 0.015 wt. %, the shape of graphite changes from spheroidal to vermicular, and if Mg content is further smaller, to flake form, and strength and toughness of the cast iron reduce. In addition, as a general tendency in spheroidal graphite cast irons, if Mg content is more than 0.1 wt. %, casting defect increase, and Mg content shall be 0.015 to 0.1 wt. %.

Heating in thermal treatment is performed in order to decompose carbides existing in the matrix structure and carbides deposit into austenite grain boundary, and to solidify in austenite. If the heating temperature is higher than 1373K, a liquid phase appears in the grain boundary, and the cast iron becomes extremely brittle. On the other hand, if the heating temperature is lower than 1073K, decomposition of carbides takes too long time, and the cost becomes higher, accordingly, the heating temperature shall be 1073 to 1373K.

The reason why heating is followed by quenching from 1073 to 1273K is that the property of cast irons, unlike that of steels, that is, the amount of carbon solidified in austenite at equilibrium changes depending on temperature is utilized to make the solidified carbon amount not causing grain boundary carbide deposition during quenching. If quenched from higher temperature than 1273K, the solidified carbon amount becomes larger, and grain boundary carbide deposits. While, it is known that quenching from temperature lower than 1073K indicates the tendency that grain boundary carbide deposits. By the present thermal treatment, an austenite matrix structure that contains no carbide or a reduced amount of carbides can be obtained.

EXAMPLES

The cast iron in the present invention is described below based on examples.

The melting method and samples in Examples are described here. As the raw materials for base melt, generally distributed pig iron, steel stock, ferromanganese, ferrosilicon, and pure nickel were used. Raw materials were blended so that chemical components of base melt become those of the goal, and melted in alumina crucibles in a 30 kg high-frequency induction furnace. With a radiation thermometer, the base melt temperature was measured, with a Mg-type spheroidizing agent, spheroidizing treatment at base melt temperature of 1773 to 1783K was performed. The molten metal spheroidization treated was inoculated with 0.8 wt. % equivalent of a Fe—Si-type inoculant, and casted into molds for samples. By setting the goal contents after spheroidizing treatment and inoculation as 3.0 to 5.0 wt. % of Si, 7.0 to 20.0 wt. % of Mn, and 0.0 to 15.0 wt. % of Ni, casting was performed, and as for each as-cast and thermal treated samples, various kinds of tests were performed. As samples for tensile test, hardness test, texture observation, x-ray diffraction, magnetic permeability measurement, thermal expansion coefficient measurement, thermal conductivity measurement, Charpy impact test, and corrosion test, round bars with the diameter of 25 mm and the length of 245 mm were obtained through casting into a knock-off type shell mold. Also, as samples for wear test, test pieces with the main body of 90 mm wide×110 mm long×15 mm thickness and the feeder part of 50×50×110 mm were casted.

Figure 3:
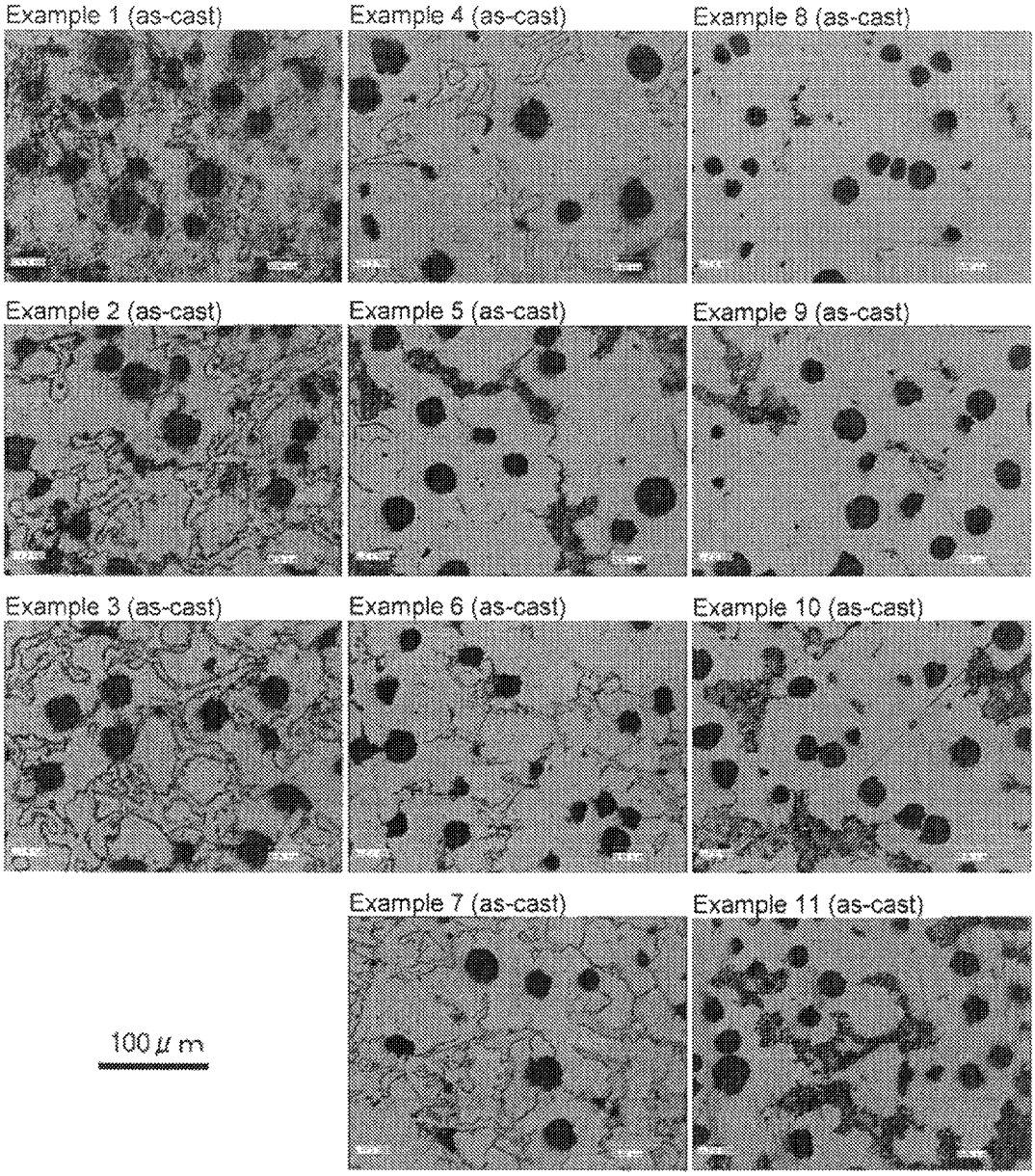
FIG. 3 includes photographic representation showing microstructure photographs of as-cast samples (Examples 1 to 11)
Figure 4:
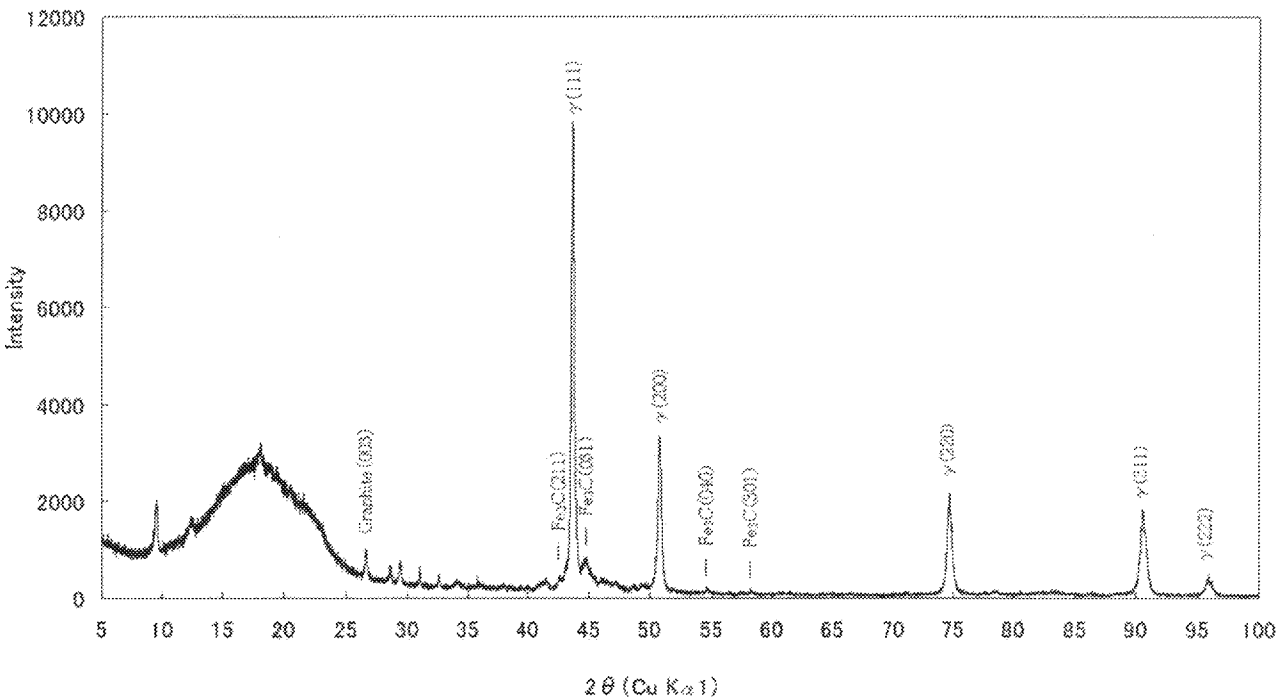
FIG. 4 is a graphical representation showing the result of x-ray diffraction of an as-cast sample (Example 17)

Properties of as-cast samples are described here based on results of Examples. In Table 1, chemical components of Examples, Comparative Examples, and Comparative Materials (FCD700-2, FCD450-10, AID (Austempered Ductile Iron), a high-manganese steel), and measured results of as-cast graphite spheroidizing ratio, hardness, magnetic permeability, and abrasion weight loss in Examples are shown. As-cast samples according to the present invention have a texture in which spheroidal graphite is dispersed in the matrix structure. As shown in Table 1, graphite spheroidizing ratios were measured by the image analysis method according to JIS G-5502 (2001), graphite spheroidizing ratios were 80% or more in all Examples and Comparative Examples. In FIG. 3, as-cast texture photographs in Examples 1 to 11 are shown. It can be confirmed that, in as-cast textures, spheroidal graphite and carbide with awkward shapes are deposited in austenite. By comparing with chemical components in Table 1, looking at texture photographs in FIG. 3 indicates the tendency that as the Mn content is larger in Examples, larger amount of carbide is deposited, and as the Ni content is larger in Examples, smaller amount of carbide is deposited. Brinell hardness of as-cast samples measured by the method according to JIS Z-2243 was 163-387 HBW, and indicated the tendency that as the Ni content is larger, the hardness becomes lower. As the reason, it can be considered that as the Ni content is larger, the carbide amount becomes smaller, and work hardening ability by Mn is reduced. Magnetic permeability of Examples 1 to 11 in the as-cast state measured with a permeameter (LP-141, Denshi Kogyo Co. Ltd.) was low magnetic as 1.020 to 2.82. In FIG. 4, the result of x-ray diffraction (RINT-2500, Rigaku Corporation) of the as-cast sample in Example 17 is shown. It can be confirmed that the sample is a low magnetic material, since the as-cast texture is consisted of spheroidal graphite+austenite (γ)+carbide with the fundamental structure of $Fe_3C$, and graphite and austenite are non magnetic.

TABLE 1

Chemical components and as-cast properties

| | Chemical component, wt. % | | | | | Graphite spheroidizing ratio | Hardness HBW | Magnetic permeability | Abrasion weight loss |
|---|---|---|---|---|---|---|---|---|---|
| Name of sample | C | Si | Mn | Ni | Mg | % | (10/3000) | μ | g |
| Example 1 | 3.3 | 3.2 | 7.1 | 0.2 | 0.021 | 80 or more | 387 | 2.82 | — |
| Example 2 | 3.4 | 2.9 | 9.0 | 0.0 | 0.028 | 80 or more | 340 | 1.78 | — |
| Example 3 | 3.3 | 3.0 | 11.0 | 0.01 or less | 0.024 | 80 or more | 340 | 1.64 | — |

TABLE 1-continued

Chemical components and as-cast properties

| Name of sample | Chemical component, wt. % C | Si | Mn | Ni | Mg | Graphite spheroidizing ratio % | Hardness HBW (10/3000) | Magnetic permeability μ | Abrasion weight loss g |
|---|---|---|---|---|---|---|---|---|---|
| Example 4 | 3.2 | 2.9 | 7.0 | 5.0 | 0.055 | 80 or more | 196 | 1.048 | — |
| Example 5 | 3.3 | 3.0 | 9.0 | 5.0 | 0.058 | 80 or more | 212 | 1.067 | — |
| Example 6 | 3.3 | 2.8 | 10.9 | 4.9 | 0.058 | 80 or more | 235 | 1.128 | — |
| Example 7 | 3.4 | 2.9 | 12.9 | 5.0 | 0.056 | 80 or more | 254 | 1.180 | — |
| Example 8 | 3.1 | 3.0 | 6.9 | 9.8 | 0.063 | 80 or more | 163 | 1.020 | — |
| Example 9 | 3.1 | 2.9 | 9.0 | 9.9 | 0.071 | 80 or more | 170 | 1.026 | — |
| Example 10 | 3.1 | 2.9 | 11.0 | 9.8 | 0.070 | 80 or more | 192 | 1.024 | — |
| Example 11 | 3.2 | 2.9 | 12.8 | 9.9 | 0.065 | 80 or more | 206 | 1.025 | — |
| Example 12 | 3.1 | 3.4 | 15.0 | 9.7 | 0.064 | 80 or more | — | — | — |
| Example 13 | 3.0 | 3.3 | 17.1 | 11.7 | 0.075 | 80 or more | — | — | — |
| Example 14 | 3.2 | 4* | 7* | 1* | 0.05* | 80 or more | — | — | 0.0042 |
| Example 15 | 3.2 | 4* | 9* | 2* | 0.05* | 80 or more | — | — | 0.0445 |
| Example 16 | 2.8 | 4.8 | 11.0 | 5.4 | 0.063 | 80 or more | — | — | — |
| Example 17 | 3.5 | 3.5 | 11.1 | 3.1 | 0.057 | 80 or more | 358 | — | — |
| Example 18 | 2.9 | 5.2 | 11.1 | 1.0 | 0.052 | 80 or more | — | — | — |
| Example 19 | 2.8 | 5.0 | 11.0 | 3.3 | 0.064 | 80 or more | — | — | — |
| Example 20 | The same cast material as Example 4 | | | | | | | | |
| Example 21 | The same cast material as Example 5 | | | | | | | | |
| Example 22 | The same cast material as Example 6 | | | | | | | | |
| Example 23 | The same cast material as Example 7 | | | | | | | | |
| Example 24 | The same cast material as Example 8 | | | | | | | | |
| Example 25 | The same cast material as Example 9 | | | | | | | | |
| Example 26 | The same cast material as Example 10 | | | | | | | | |
| Example 27 | The same cast material as Example 11 | | | | | | | | |
| Comparative Example 1 | 3.2 | 3.3 | 20.0 | 14.5 | 0.067 | 80 or more | — | — | — |
| FCD700-2 (JIS G-5502) | 3.7 | 2.7 | — | — | 0.04 | — | 259 | ←in the as-cast state | |
| FCD450-10 (JIS G-5502) | 3.8 | 2.7 | — | — | 0.04 | — | 183 | ←in the as-cast state | |
| ADI (Austempered Ductile Iron) | 3.8 | 2.7 | — | — | 0.04 | — | 347 | ←in the ADI treated state | |
| High-manganese Steel | 1.28 | — | 12.6 | — | — | — | — | — | — |

*the goal component value

Figure 5:
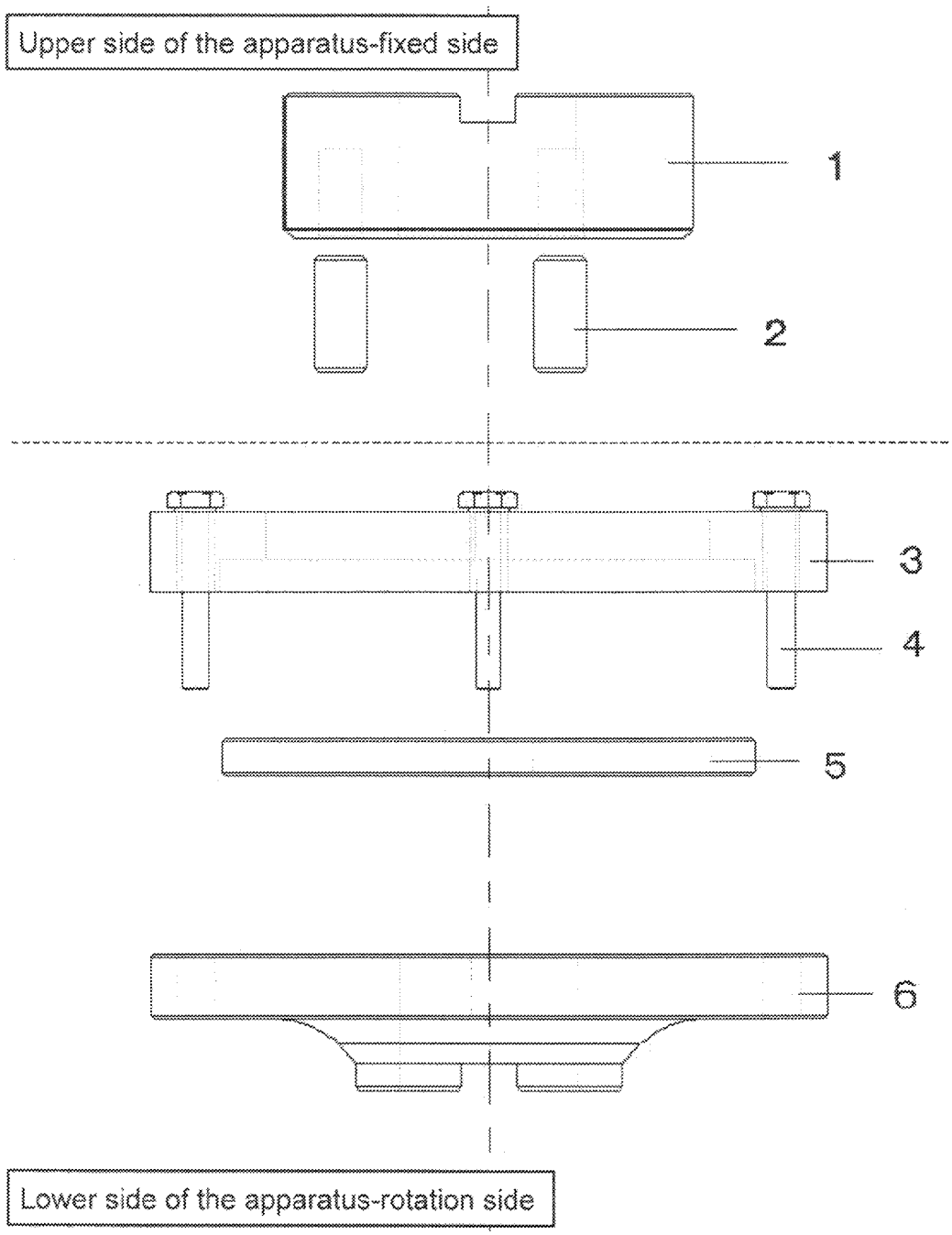
FIG. 5 is a diagram showing the sample attaching portion of the wear resistance tester.

Evaluation of wear resistance of as-cast samples was performed, with a friction and wear tester (EFM-3-EN, A & D Company, Limited) being possible friction and wear tests according to JIS K-7218, by a method applied the method B of the standard. In FIG. 5, a sample attached to the tester with a disk shape, the counterparts with a pin shape, and jigs to fix them are shown. In order to fit the upper and lower projections of the sample attachment part of the tester, grooves were made on the upper and lower sides of the fixing jig. A disk-shaped sample (60 mm diameter×4 mm thickness) shown in FIG. 5 was sandwiched between jigs 3 and 6, tightened up with the bolts 4, and the disk 5 was fixed and attached to the lower side of the tester. On the other hand, the three pins 2 (made of a super hard alloy: HTi10, Mitsubishi Materials Corporation, 6 mm diameter, C0.5 chamfered, HRA 92 hardness) being the counterparts were inserted in the hole of the jig 1, and with taking care not to fall down the pins 2, so that the tips of pins 2 touch to the disk 5, were attached to the tester. Holes for pins 2 were placed at regular intervals on the circumference with the diameter of 33 mm and the center being the rotation center. Pins 2 were fixed and the disk 5 was rotated, and they constructed a mechanism that by rotation under pressure, the disk 5 being the test sample was worn with pins 2. The test pressure force was conserved to 10 kgf, and at disk rotation speed of 83 rpm, the test was performed. Comparison between the wear weight losses of as-cast samples of Examples 14 and 15 in Table 1 and those of FCD450-10 and FCD700-2 in Table 3 described later shows that materials in Examples 14 and 15 had much smaller wear weight losses and are materials with excellent wear resistance. The as-cast sample in Example 14 showed smaller wear weight loss than all thermal treated samples of Examples, ADI, and the high-manganese steel in Table 3, and indicated its excellent wear resistance. It can be considered that since the massive carbide deposited in the as-cast state was a hard material, and improved wear resistance. As-cast materials have low toughness, and are suitable for applications not receiving impacts and requiring wear resistance.

Properties of thermally treated samples are described here based on results of Examples. The thermal treatment in Examples was performed by cutting off the feeder parts of knock-off type test pieces, the round bar parts were suspended with wires and entered into a heat-treating furnace, and in nitrogen-atmosphere to prevent decarburization caused by high-temperature heating. As shown in Table 2, carbide decomposition treatment was performed at 1323K for 2 to 15 hours. Then the temperature was lowered to 1123K or 1173K, and held for 30 to 60 minutes, then test pieces were taken out from the furnace, and soaked in water. After they were confirmed to be cooled sufficiently, they were pulled out from water.

TABLE 2

| Name of sample | Decomposition temperature K | Decomposition time hr. | Quenching temperature From the quenching temperature (K), soaked in water | Tensile strength MPa | Proof strength MPa | Elongation % | Hardness HBW (10/3000) | Impact value: V-notch(J/cm²) Ordinary temperature | | 203 K | | 77 K | |
|---|---|---|---|---|---|---|---|---|---|---|---|---|---|
| | Properties after heat treatment | | | | | | | | | | | | |
| Example 1 | 1323 | 2 | 1173 | 536 | 415 | 9.0 | 206 | 14.03 | 14.71 | 7.42 | 7.64 | 6.28 | 6.05 |
| Example 2 | 1323 | 2 | 1173 | 545 | 470 | 6.2 | 229 | 9.92 | 10.61 | 7.42 | 7.42 | 5.36 | 5.82 |
| Example 3 | 1323 | 2 | 1173 | 545 | 524 | 2.4 | 277 | 8.10 | 8.33 | 7.42 | 7.19 | 5.82 | 5.59 |
| Example 4 | 1323 | 2 | 1173 | 582 | 383 | 27.6 | 180 | 40.92 | 39.56 | 16.99 | 16.53 | 6.50 | 6.73 |
| Example 5 | 1323 | 2 | 1173 | 645 | 401 | 30.4 | 186 | 34.09 | 33.86 | 26.79 | 26.79 | 7.64 | 7.64 |
| Example 6 | 1323 | 2 | 1173 | 583 | 429 | 19.0 | 204 | 19.27 | 20.41 | 16.31 | 16.99 | 7.87 | 8.32 |
| Example 7 | 1323 | 2 | 1173 | 522 | 460 | 10.2 | 217 | 11.29 | 11.29 | 9.92 | 10.38 | 7.64 | 7.87 |
| Example 8 | 1323 | 2 | 1173 | 597 | 348 | 37.2 | 163 | 37.50 | 36.82 | 35.45 | 35.91 | 11.29 | 11.29 |
| Example 9 | 1323 | 2 | 1173 | 553 | 364 | 24.4 | 173 | 36.36 | 35.68 | 32.72 | 34.54 | 20.46 | 20.91 |
| Example 10 | 1323 | 2 | 1173 | 595 | 384 | 30.2 | 183 | 35.23 | 35.23 | 29.98 | 30.86 | 20.46 | 20.46 |
| Example 11 | 1323 | 2 | 1173 | 578 | 409 | 22.0 | 183 | 29.30 | 30.89 | 26.56 | 24.28 | 17.04 | 16.81 |
| Example 12 | 1323 | 2 | 1123 | 555 | 405 | 20.0 | 196 | 20.42 | 20.65 | 20.84 | 20.42 | 14.01 | 12.63 |
| Example 13 | 1323 | 2 | 1123 | 451 | 398 | 8.8 | 174 | 14.24 | 9.89 | 11.26 | 14.46 | 9.89 | 9.89 |
| Example 14 | 1323 | 2 | 1173 | 561 | — | 13.4 | 217 | 16.30 | 16.07 | 7.14 | 7.14 | 7.92 | 7.69 |
| Example 15 | 1323 | 2 | 1173 | 504 | — | 10.2 | 217 | 32.09 | 30.72 | 11.26 | 11.95 | 8.15 | 8.15 |
| Example 16 | 1323 | 2 | 1173 | 721 | 417 | 34.4 | 212 | — | — | — | — | — | — |
| Example 17 | 1323 | — | 1173 | 712 | 393 | 31.0 | 203 | 22.10 | — | — | — | 10.40 | — |
| Example 18 | 1323 | 2 | 1173 | 716 | 496 | 17.2 | 250 | 27.02 | 27.02 | 11.52 | 11.97 | 9.51 | 9.06 |
| Example 19 | 1323 | 2 | 1173 | 709 | 445 | 29.4 | 221 | — | — | — | — | — | — |
| Example 20 | 1323 | 15 | 1123 | 594 | 366 | 24.2 | 180 | — | — | — | — | — | — |
| Example 21 | 1323 | 15 | 1123 | 687 | 384 | 38.2 | 192 | — | — | — | — | — | — |
| Example 22 | 1323 | 15 | 1123 | 664 | 406 | 30.8 | 201 | — | — | — | — | — | — |
| Example 23 | 1323 | 15 | 1123 | 546 | 449 | 14.2 | 217 | — | — | — | — | — | — |
| Example 24 | 1323 | 15 | 1123 | 583 | 340 | 36.0 | 169 | — | — | — | — | — | — |
| Example 25 | 1323 | 15 | 1123 | 530 | 367 | 22.8 | 168 | — | — | — | — | — | — |
| Example 26 | 1323 | 15 | 1123 | 619 | 364 | 39.6 | 173 | — | — | — | — | — | — |
| Example 27 | 1323 | 15 | 1123 | 609 | 379 | 34.6 | 174 | — | — | — | — | — | — |
| Comperative Example 1 | 1323 | 2 | 1123 | 384 | — | 3.0 | 192 | 6.91 | 7.14 | 6.68 | 7.14 | 6.91 | 7.60 |
| FCD700-2 (JIS G-5502) | — | — | — | — | — | — | — | — | — | — | — | — | — |
| FCD450-10 (JIS G-5502) | — | — | — | — | — | — | — | — | — | — | — | — | — |
| ADI (Austempered Ductile Iron) | — | — | — | — | — | — | — | — | — | — | — | — | — |
| High-manganese Steel | 1323 | 2 | 1323 | 717 | 464 | 30.8 | 189 | ←in water tougheing treated state | | | — | — | — |

Texture of Heat-Treated Samples

Figure 6:
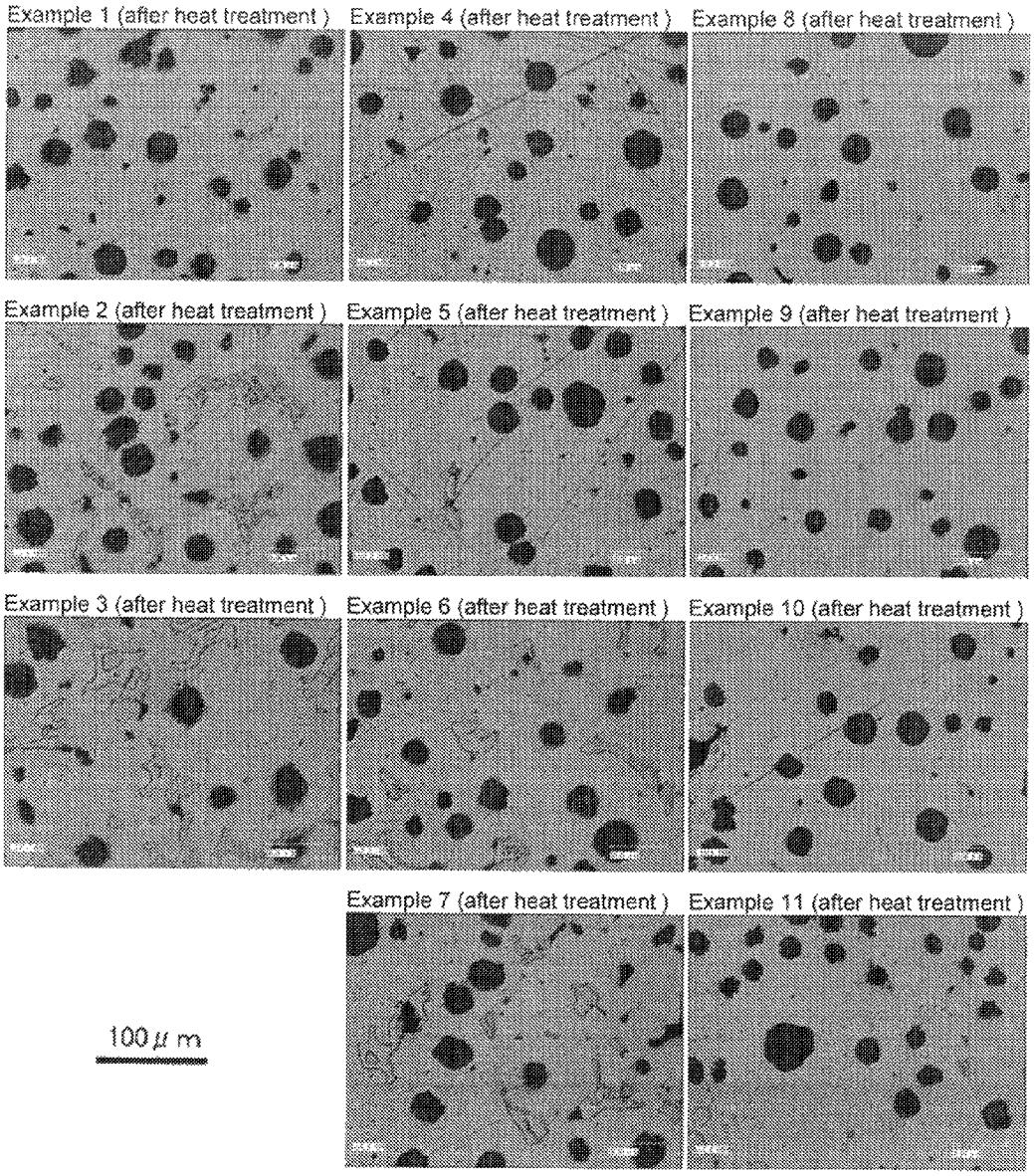
FIG. 6 includes photographic representation showing microstructure photographs of heat-treated samples (Examples 1 to 11)
Figure 7:
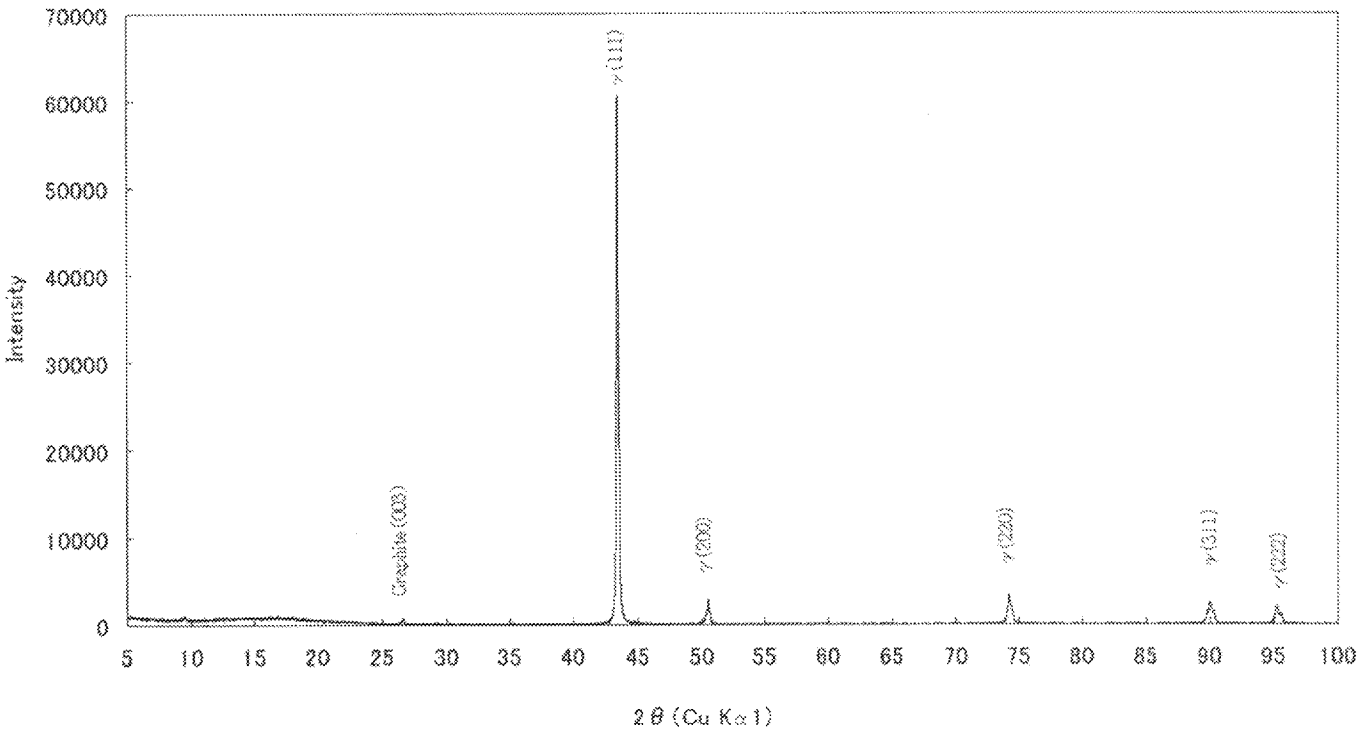
FIG. 7 is a graphical representation showing the result of x-ray diffraction of the heat-treated sample (Example 17).

By comparing with chemical components in Table 1, looking at after heat-treated texture photographs in FIG. 6 indicates that, in no-Ni added samples of Examples 1 to 3, as the Mn content increase, even after two-hours holding at the carbide decomposition temperature, un-decomposed massive carbide exists. As the Ni content becomes larger, the amount of carbide after heat treatment becomes smaller, and in samples containing 10 wt. % of Ni of Examples 8 to 11, almost all carbides are decomposed and an uniform austenitic texture is made. In FIG. 7, the result of x-ray diffraction of the heat treated sample in Example 17 is shown. All peaks are for graphite and austenite (γ), and peaks for carbide seen that of the as-cast sample are disappeared.

Mechanical Properties of Heat-Treated Samples

As the result of processing heat-treated samples into No. 4 test pieces of JIS Z-2201 and performing tensile test, as shown in Table 2, tensile strength for all Examples was more than 450 MPa, and in samples containing several wt. % or more of Ni, a tendency that higher elongation for their tensile strength is shown was seen. The sample of Example 16 containing 5.4 wt. % of Ni was a material that had not been realized in spheroidal graphite cast irons so far which had both of high tensile strength as 721 MPa and large elongation as 34.4%. As for samples with the same compositions as that of samples of Examples 4 to 11 with quenching temperature of 1173K, when they were quenched from 1123K in Examples 20 to 27, they showed the tendency that tensile strength and elongation became larger and proof strength became smaller than that in Examples 4 to 11. Therefore, it is indicated that if a material prioritizing toughness is requested, setting the quenching temperature lower is effective.

The casting iron according to the present invention, although having an austenitic matrix structure, can have 400 MPa or more of proof strength by selecting Ni content and heat treatment conditions. The sample in Example 18 containing 1.0 wt. % of Ni showed 716 MPa of tensile strength, 496 MPa of proof strength, and 17% of elongation, and is suitable for applications such as structural materials requiring both of tensile strength and proof strength. Brinell hardness measured according to JIS Z-2243 of heat treated samples were 163-277 HBW, and lower than that of as-cast samples. From results of Charpy impact test with the V notch measured according to JIS B-7722, the impact value of the sample comprising the Ni content of 5 wt. % in Example 5 was 26 J/cm$^2$ at 203K, and indicates that it has been made to be a material with excellent low-temperature impact properties with low cost. Samples comprising Ni content of 10 wt. % in Examples 8, 9, and 10 had further excellent low-temperature impact properties, and impact values in Examples 9 and 10 at super low-temperature of 77K were 20 J/cm$^2$ or more. Here, focusing on the sample in Comparative Example 1 containing 20 wt. % of Mn, it had elongation of 3.0% for tensile strength of 384 MPa, and showed the embrittlement tendency. Since the sample containing 17 wt. % of Mn in Example 13 had elongation of 8.8%, it can be determined that if the Mn content is 18 wt. % or less, the embrittlement tendency may be inhibited by comprising Ni, and the material can be applied as such as structural materials.

TABLE 3

| Properties after carbide decomposition and heat-treatment | | | | | | |
|---|---|---|---|---|---|---|
| | | | | | Corrosion weight loss | |
| Name of sample | Magnetic permeability μ | Abrasion weight loss g | Thermal expansion coefficient $\times 10^{-6}$ (1/K) 323~373 K | Themal conductivity W/m · K Ordinary temperature ~373 K | 3 wt. % NaCl water solution 500 hr. g | 50 volume % hydrochloric acid water solution 96 hr. g |
| Example 1 | 1.005 | 0.0129 | 19.2 | 13.6~18.8 | — | — |
| Example 2 | 1.004 | 0.0161 | 18.3 | 16.7~18.5 | — | — |
| Example 3 | 1.004 | 0.0160 | 17.1 | 15.3~17.1 | 0.0227 | 0.5155 |
| Example 4 | 1.004 | 0.0298 | 18.6 | 18.0~19.4 | — | — |
| Example 5 | 1.004 | 0.0387 | 18.8 | 13.9~14.9 | — | — |
| Example 6 | 1.004 | 0.0210 | 19.5 | 16.6~17.3 | 0.0211 | 0.2189 |
| Example 7 | 1.005 | 0.0342 | 18.5 | 13.5~15.6 | — | — |
| Example 8 | 1.005 | 0.3247 | — | — | — | — |
| Example 9 | 1.004 | 0.1510 | — | — | — | — |
| Example 10 | 1.004 | 0.1422 | 18.4 | 11.4~12.7 | 0.0186 | 0.1233 |
| Example 11 | 1.004 | 0.0774 | 18.1 | 15.2~18.4 | — | — |
| Example 12 | 1.004 | 0.0825 | 18.8 | 11.6~12.5 | — | — |
| Example 13 | 1.004 | 0.0950 | 19.8 | 11.1~11.9 | — | — |
| Example 14 | 1.004 | 0.0210 | — | — | — | — |
| Example 15 | 1.003 | 0.0336 | — | — | — | — |
| Example 16 | 1.005 | — | — | — | — | — |
| Example 17 | — | — | — | — | — | — |
| Example 18 | 1.006 | 0.0628 | 17.8 | 11.6~14.1 | — | — |
| Example 19 | 1.006 | 0.0272 | — | — | — | — |
| Example 20 | 1.004 | — | — | — | — | — |
| Example 21 | 1.004 | — | — | — | — | — |
| Example 22 | 1.004 | — | — | — | — | — |
| Example 23 | 1.004 | — | — | — | — | — |
| Example 24 | 1.004 | — | 18.1 | 14.0~16.1 | — | — |
| Example 25 | 1.004 | — | 20.1 | 16.4~17.5 | — | — |
| Example 26 | 1.004 | — | — | — | — | — |
| Example 27 | 1.003 | — | — | — | — | — |
| Comparative Example 1 | 1.004 | 0.0750 | 17.6 | 10.2~13.0 | — | — |
| FCD700-2 (JIS G-5502) | — | 2.8053 | ←in the as-cast state | — | — | — |
| FCD450-10 (JIS G-5502) | — | 3.0584 | ←in the as-cast state | — | 0.0219 | 0.4996 |
| ADI (Austempered Ductile Iron) | — | 0.0161 | ←in the ADI treated state | — | — | — |
| High-manganese Steel | 1.003 | 0.0135 | ←in water toughening treated state | — | — | — |

Magnetic Properties of Heat-Treated Samples

As a result of measurement of heat-treated samples with a permeameter (FEROMASTER permeability Meter, Stefan Mayer Instruments), as shown in Table 3, magnetic permeability (μ) for all samples in all Examples measured was in the range of from 1.003 to 1.006, and indicated to be non-magnetic (1.02 or less). The magnetic permeability measured in Examples are almost the same level of those of the high-manganese steel and SUS304 (SCS13), and smaller level than that of ductile Ni-resist cast irons.

Wear Resistance of Heat-Treated Samples

Evaluation of wear resistance of heat-treated samples was performed by the same evaluation method used for as-cast samples described above. Table 3 shows that heat-treated samples in Examples had abrasion weight loss of 0.01 to 0.32 g, much smaller than that of FCD450-10 and FCD700-2, 2.8 g and 3.1 g, respectively, and they have excellent wear resistance. Also, it was shown that as Ni content was smaller, abrasion weight loss became smaller, samples in Examples 1 to 3 to which Ni was not added had 0.013 to 0.016 g of abrasion weight loss, and they have the same level of wear resistance as that of ADI and high-manganese steels which are said to have very good wear resistance. By selecting the Ni content in response to requests such as mechanical properties and corrosion resistance, to manufacture a material suitable for the application is possible.

Physical Properties of Heat-Treated Samples

As shown in Table 3, thermal expansion coefficients (TMA8310, Rigaku Corporation) at 323 to 373K of cast irons according to the present invention are 17-20×$10^{-6}$/K, being very near to those of high-manganese steels. Since their matrix structures are austenite, their thermal expansion coefficients are larger than those of ferritic and pearlitic spheroidal graphite cast irons, and care should be taken when manufacturing long products. In addition, their thermal conductivity (LFA457-A21, Microflash, NETZSCH) in the range from ordinary temperature to 373K is 11 to 19 W/m·K, being about half or less than those of ferritic and pearlitic spheroidal graphite cast irons. As its thermal conductivity is smaller, as suitable for such as peripheral parts of low-temperature storage tanks the material is.

Corrosion Resistance of Heat-Treated Samples

From, with comparable level of Si content, the heat-treated sample in Example 3 to which no Ni was added, the heat-treated sample in Example 6 with Ni content of 5 wt. %, the heat-treated sample in Example 10 with Ni content of 10 wt. %, and FCD450-10 being the comparative material, coins (20 mm diameter×5 mm thickness) as samples for corrosion resistance test were processed, then they were soaked in 3 wt. % NaCl water solution for 500 hours, in 50 volume % hydrochloric acid water solution for 96 hours, respectively, and each corrosion weight loss was measured. As shown in Table 3, the corrosion weight loss measurement results with 3 wt. % NaCl water solution indicated the tendency that as Ni content was larger, corrosion weight loss became smaller, and corrosion resistance was improved. Corrosion weight loss of FCD450-10 was near level of the sample in Example 3 not comprising Ni. On the other hand, from the results obtained from soaking in 50 volume % hydrochloric acid water solution for 96 hours, it was confirmed that compared with corrosion weight loss of the sample in Example 3 to which no Ni was added, that of the sample in Example 6 comprising 5 wt. % of Ni became about ⅖, and that of the sample in Example 10 comprising 10 wt. % of Ni became about ⅕, and their corrosion resistance toward hydrochloric acid were largely improved. When the sample in Example 3 to which no Ni was added and FCD450-10 were compared, large difference in corrosion weight loss was not found, and showed that they have the same level of corrosion resistance toward hydrochloric acid.

Machinability of Heat-Treated Samples

During lathe machining of test pieces for tensile test, evaluation of machinability was performed. As for the evaluation method, since, in general, as machinability is better, the speed of rotation can be set larger, and the feed and incision can be set larger, during turning of the high-manganese steel, FCD450-10, and cast irons according to the present invention, the largest setup values not causing discoloration by seizing at worked surfaces were explored, and each machinability was evaluated. As the machinability test results, in Table 4, each incision, feed, speed of rotation, and processing time ratio to that of FCD450-10 determined by ratios of these factors to those of FCD450-10 are shown. The materials of the present invention, when compared with that of FCD450-10 being said to have excellent machinability, need about three-times longer processing time, but that of the high-manganese steel is about 17-times larger, and it is shown that the materials of the present invention, compared with the high-manganese steel, have excellent machinability, and shorter processing time.

TABLE 4

Results of machinability test

| Machined material | Incision mm | Feed mm | Speed of rotation rot./min. (m/min.) | Processing time ratio to that of FCD450-10 |
|---|---|---|---|---|
| FCD450-10 | 2.0 | 0.17 | 580 (41) | 1 |
| Cast irons according to the present invention | 2.0 | 0.09 | 387 (28) | 2.9 |
| High-manganese Steel | 0.8 | 0.05 | 295 (21) | 16.7 |

super hard alloy chip use: M20 (UTi20T: Mitsubishi Materials Corporation)

Used ultra-hard chip: M20 (UTi20T, Mitsubishi Materials Corporation)

INDUSTRIAL APPLICABILITY

Cast irons according to the present invention are materials with excellent low magnetism, toughness, low-temperature toughness, wear resistance, castability, and machinability. They can be used as the substitute of high-manganese steels, austenitic stainless steels, and ductile Ni-resist cast irons in non-magnetic applications and low-temperature applications, and as the substitute of high-manganese steels in wear resistance applications. The materials having both of non magnetism and low-temperature toughness can be used in applications expected to demand expansion such as motor parts and liquefied gas storage tank peripheral parts, or structural materials of superconducting facilities and fusion rector facilities. In addition, since they have both of toughness and wear resistance, they can be used in applications such as mining machinery. Excellent castability of these cast irons makes it possible to manufacture products with thin or complex shapes, and to respond to reasonable designs depending on the application. Furthermore, their excellent machinability enlarges design freedom and improves processing accuracy, and their increasing use is expected.

What is claimed is:

1. A manufacturing method of a high-manganese spheroidal graphite cast iron having a composition which contains 2.5 to 4.0 wt. % of C, 1.5 to 6.0 wt. % of Si, 7.0 to 18.0 wt. % of Mn, and 0.015 to 0.1 wt. % of Mg, and contains Ni in an amount of 0 to 10.0 wt. % when the Mn content falls within the range of 7.0 to 10.0 wt. %, or in an amount satisfying the relationship of formula (I) below when the Mn content falls within the range of 10.0 to 18.0 wt. %, with the balance being Fe and impurities: which comprises (a) heating the cast iron to a temperature of 1273 to 1373K to decompose carbides and to solidify in austenite, (b) holding the cast iron for 30-60 minutes at a temperature of 1073 to 1273K, wherein the heating temperature of (a) and the holding temperature of (b) are different, and then (c) quenching from 1073 to 1273K the resulting cast iron to form a metastable austenite matrix structure that contains no carbide or a reduced amount of carbides, $$\text{Mn wt. \%} > \text{Ni wt. \%} \geq 0 \quad (1).$$

2. A manufacturing method of a high-manganese spheroidal graphite cast iron having a composition which consists of 2.5 to 4.0 wt. % of C, 1.5 to 6.0 wt. % of Si, 7.0 to 18.0 wt. % of Mn, and 0.015 to 0.1 wt. % of Mg, and contains Ni in an amount of 0 to 10.0 wt. % when the Mn content falls within the range of 7.0 to 10.0 wt. %, or in an amount satisfying the relationship of formula (1) below when the Mn content falls within the range of 10.0 to 18.0 wt. %, with the balance being Fe and impurities: which comprises (a) heating the cast iron to a temperature of 1273 to 1373K to decompose carbides and to solidify in austenite, (b) holding the cast iron for 30-60 minutes at a temperature of 1073 to 1273K, wherein the heating temperature of (a) and the holding temperature of (b) are different, and then (c) quenching from 1073 to 1273K the resulting cast iron to form a metastable austenite matrix structure that contains no carbide or a reduced amount of carbides, $$\text{Mn wt. \%} > \text{Ni wt. \%} \geq 0 \quad (1).$$

3. The manufacturing method according to claim 1, comprising (a) heating the cast iron to a temperature of 1323 to 1373K.

4. The manufacturing method according to claim 1, comprising (b) holding the cast iron for 30-60 minutes at a temperature of 1123 to 1173K.

* * * * *